United States Patent [19]

Salmon et al.

[11] Patent Number: 4,735,239

[45] Date of Patent: Apr. 5, 1988

[54] LIQUID PROJECTING DEVICE

[75] Inventors: Michael E. Salmon, Flint; John S. Briski, Homer, both of Mich.

[73] Assignee: Water Weenies, Inc., Grand Blanc, Mich. ; by said John Briski

[21] Appl. No.: 909,834

[22] Filed: Sep. 19, 1986

[51] Int. Cl.[4] ..... B65B 3/04

[52] U.S. Cl. ..... 141/25; 141/114; 141/351; 141/126; 222/105; 222/107; 222/213; 222/633; 446/473

[58] Field of Search ..... 141/1-12, 141/18-29, 114, 351, 115-127, 285-310; 222/92, 105, 107, 213, 215, 632, 633; 446/473

[56] References Cited

U.S. PATENT DOCUMENTS

| | | | |
|---|---|---|---|
| 1,392,861 | 10/1921 | Tabacco | 446/186 |
| 3,025,634 | 3/1962 | Barricks | 46/88 |
| 3,486,539 | 12/1969 | Jacuzzi | 141/329 |
| 3,940,026 | 2/1976 | Kain | 222/212 |
| 4,121,737 | 10/1978 | Kain | 222/95 |
| 4,134,228 | 1/1979 | Ortiz | 46/88 |
| 4,222,499 | 9/1980 | Lee et al. | 222/183 |
| 4,257,460 | 3/1981 | Paranay | 46/26 |
| 4,324,350 | 4/1982 | Thompson | 222/212 |
| 4,387,833 | 6/1983 | Venus, jr. | 222/95 |
| 4,419,096 | 12/1983 | Leeper et al. | 604/132 |
| 4,423,829 | 1/1984 | Katz | 222/95 |
| 4,458,830 | 7/1984 | Werding | 222/131 |
| 4,555,295 | 11/1985 | Orikasa et al. | 141/114 |

*Primary Examiner*—Houston S. Bell, Jr.
*Attorney, Agent, or Firm*—John E. Nemazi

[57] ABSTRACT

The device uses an elastic tubular bladder for receiving liquid which is expandable radially generally spherically at a local segment until a fully-expanded cross-section is achieved at which time the expanded region begins to grows axially, thereby maintaining a relatively constant pressure independent of bladder volume. The device is provided with a nozzle and a valve for controlling and directing the flow of the projected liquid.

18 Claims, 3 Drawing Sheets

FIG.6
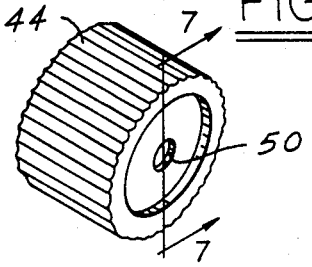
FIG.7
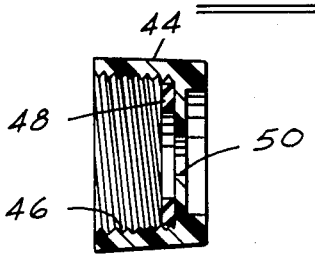
FIG.8
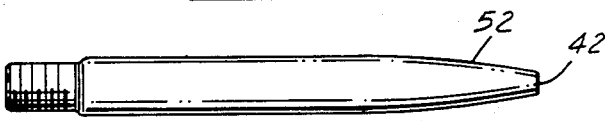
FIG.9
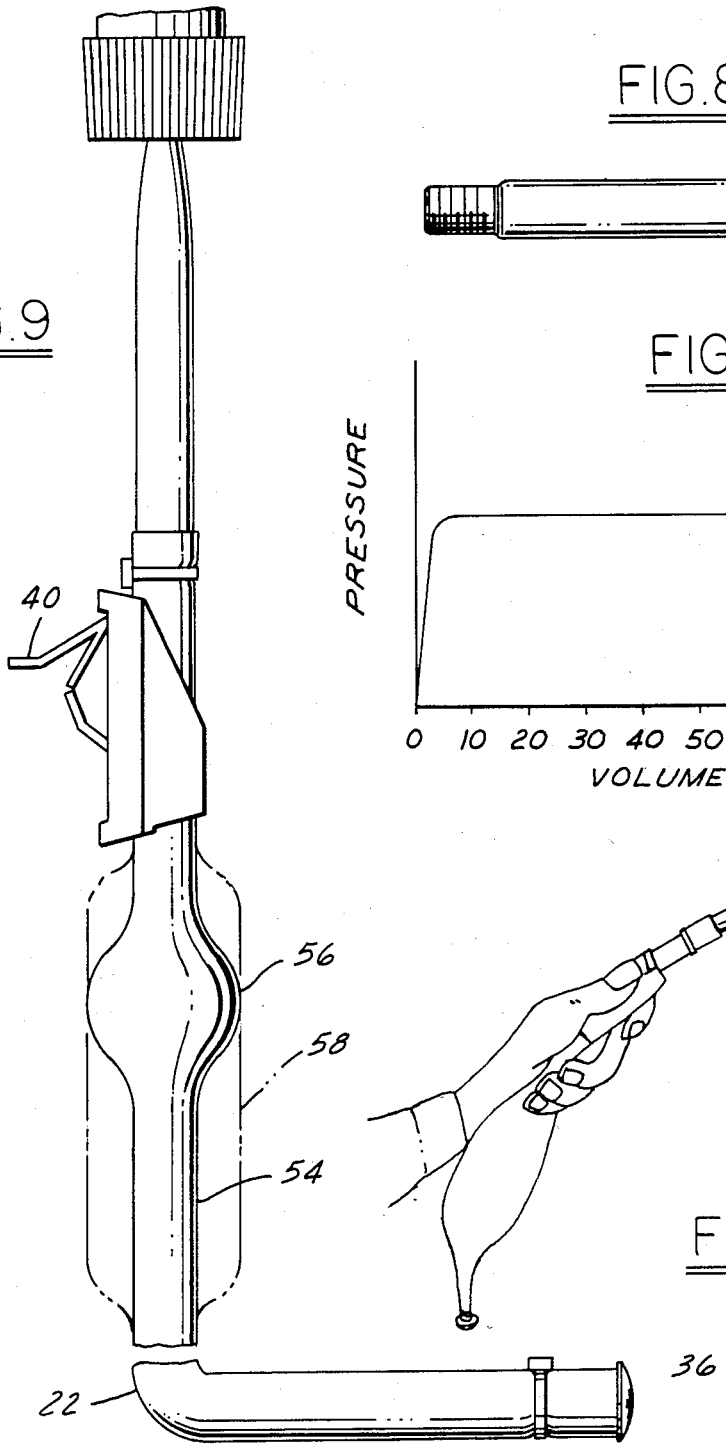
FIG.10
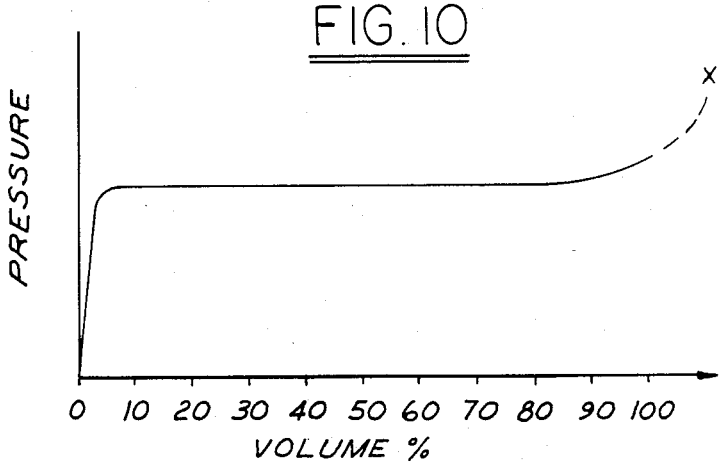
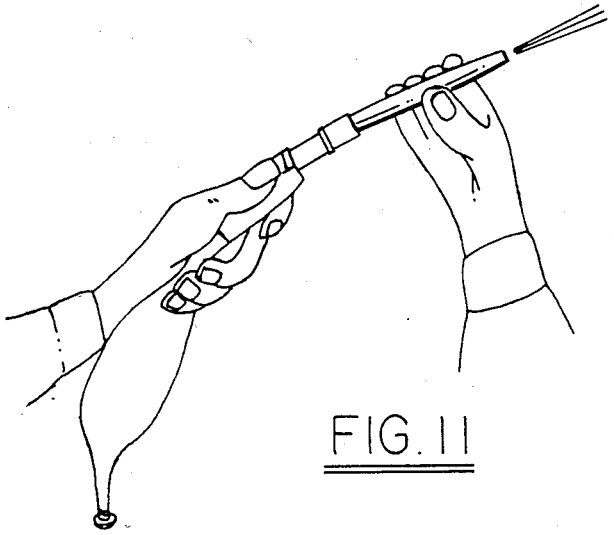
FIG.11

LIQUID PROJECTING DEVICE

FIELD OF INVENTION

This invention relates to a liquid projecting device and, more particularly, to a liquid projecting device having an expandable, elastic bladder to maintain liquid in a pressurized state.

BACKGROUND OF INVENTION

Elastic bladders for holding a fluid have been known in the art for some time. For example, a variety of children's toys have been fabricated using balloons for an elastic reservoir for pressurized air. An example of several balloon toys are shown in U.S. Pat. Nos. 1,392,861; 3,025,634; and 4,134,228. An example of a water projecting toy utilizing an elastic, liquid reservoir is shown in U.S. Pat. No. 4,257,460, Paranay, et al. The Paranay patent employs an expandable bladder formed of a thick-walled, hard rubber tubular material.

The object of the present invention is to provide a liquid projecting device which maintains liquid in a pressurized reservoir at a relatively constant pressure independent of reservoir volume enabling uniform fluid projection characteristics throughout operation.

A further object of the invention is to provide a simple, easy to manufacture water projecting device.

Yet another object of the invention is to provide a water projecting device which cannot be damaged due to overfilling.

SUMMARY OF INVENTION

Accordingly, a water-projecting device of the present invention includes a tubular elastic bladder for receiving a liquid, a nozzle affixed to the bladder for projecting the liquid, and a control valve for regulating the discharge. The elastic bladder extends along an axis and is expandable radially from an initial cross-section to an expanded cross-section upon the introduction of fluid. As fluid is introduced, the bladder expands generally spherically at a local segment of the tube until the expanded cross-section is achieved. Thereafter as additional liquid is introduced into the bladder, the expanded region grows axially until the entire effective length of the tube has reached the expanded cross-section. The pressure of the liquid within the bladder is generally constant independent of the fluid volume contained therein.

An overfill release valve is also described which automatically exhausts liquid from the tubular bladder once the maximum volume has been reached.

BRIEF DESCRIPTION OF THE DRAWINGS

FIG. 6 is a perspective view of a filling adaptor;

FIG. 7 is a cross-sectional view of the filling adaptor taken along line 7—7 in FIG. 6;

FIG. 8 is a side view of the nozzle;

FIG. 9 is a side view illustrating the device during the filling operation;

FIG. 10 is a plot showing the liquid pressure/volume relationship;

FIG. 11 is a perspective view of the preferred embodiment of the invention being operated by a user;

DESCRIPTION OF PREFERRED EMBODIMENT

Figure 1:
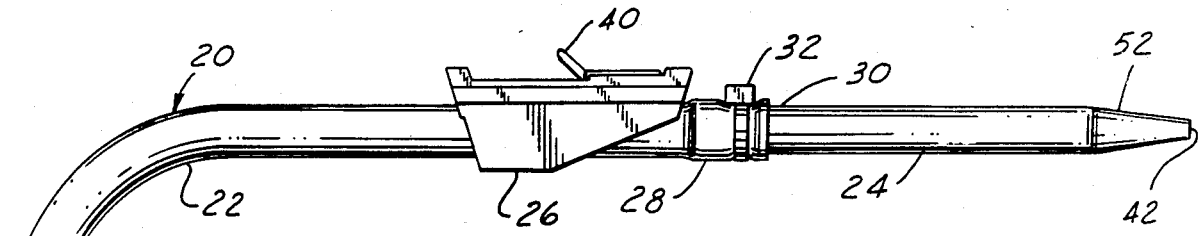
FIG. 1 is a side view of a preferred embodiment of the liquid projecting device in the empty state with the bladder shown partially filled in dotted outline.
Figure 2:
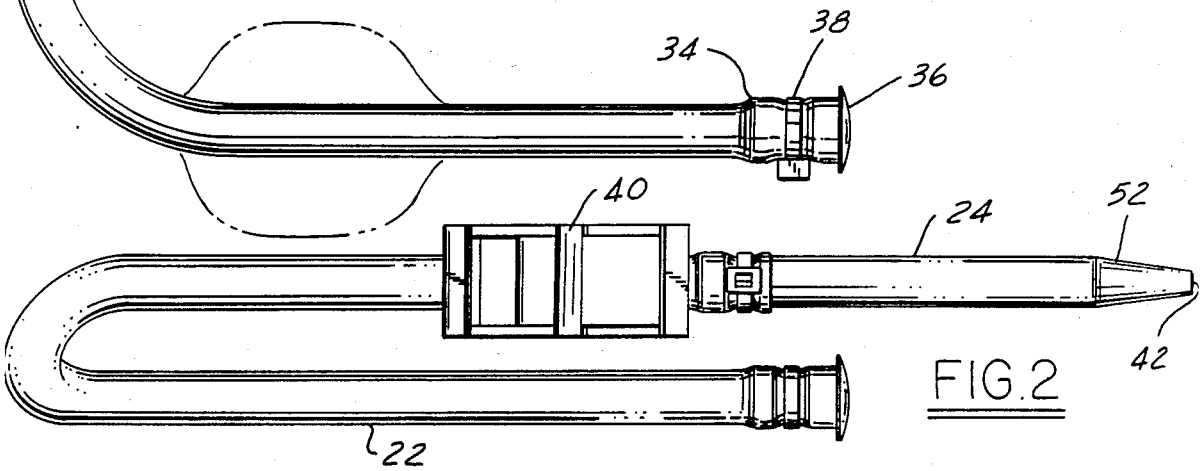
FIG. 2 is a top view of the device shown in FIG. 1.
Figure 3:
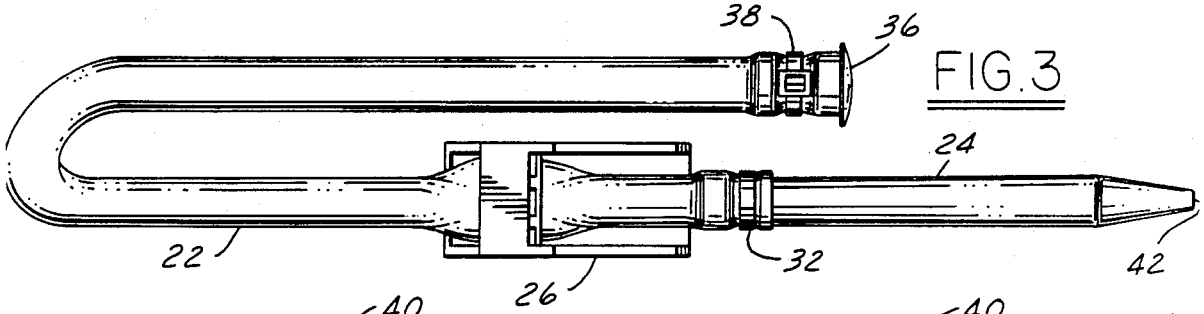
FIG. 3 is a bottom view of the device shown in FIG. 1.
Figure 4:
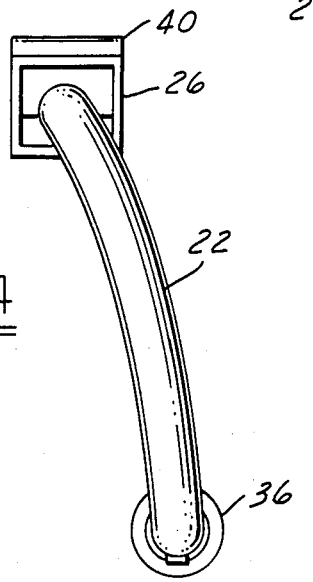
FIG. 4 is a left side view of the device shown in FIG. 1.
Figure 5:
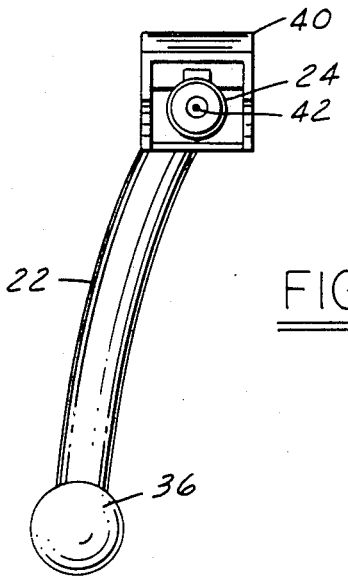
FIG. 5 is a right side view of the device shown in FIG. 1.

FIGS. 1 through 5 show a variety of views of a first embodiment of the liquid projecting device 20. The device is made up of three main components: a tubular bladder 22, a nozzle 24, and a flow-control valve 26. The tubular bladder is designed for receiving fluid and upon the entry of such fluid, the bladder will expand elastically to maintain the fluid in the pressurized state. The bladder is provided with a first and second end. The first end 28 telescopically slides over the first end 30 of nozzle 24. The bladder is maintained affixed to the nozzle by clamp 32. The bladder second end 34 telescopically slides over plug 36 and is similarly retained in place by a clamp 38. Affixed to the bladder adjacent the bladder first end is valve 26. The valve is provided with a lever 40 movable from the closed position shown in FIG. 1 to the open position shown in FIG. 9. Valve 26 pinches the tubular bladder 22 to sealingly close off the tube to prevent the escape of liquid. As the lever 40 is raised the pinch in the hose is released allowing liquid to flow through the valve and through the tubular nozzle 24 to exit through orifice 42 formed in the nozzle second end.

The filling of the liquid projecting device is depicted in FIG. 9. An adaptor shown in FIG. 6 and a cut-away in FIG. 7 is fixed to a garden hose or an exterior faucet. The adaptor is provided with internal threads 46 and an annular seal 48 to allow the adaptor to sealingly engage the male threaded end of the garden hose. The adaptor is provided with a port 50 sized to allow the insertion of the nozzle on the second end 52 therein. The nozzle is merely held securely in place as depicted in FIG. 9 during the filling operation. While filling, valve 26 is opened by raising lever 40 as shown and water is forced through orifice and the nozzle and into the elastic tubular bladder. When the bladder is full, the valve 26 is closed and the device is ready for use.

During the filling operation, the bladder will initially begin to expand spherically at a single, localized segment of the bladder. The bladder will expand from its size and cross-section shown in unexpanded region 54 to its fully expanded cross-section depicted by the spherically expanded region 56. Additional entry of liquid into the bladder causes the fully expanded spherical region 56 to grow along the axis of the tubular bladder as shown in phantom outline 58. The tube by expanding in such a manner results in a generally constant liquid pressure within the bladder independent upon total liquid volume contained therein. A typical pressure versus volume diagram is shown in FIG. 10. This novel pressure versus volume relationship enables the liquid projecting device to squirt or spray liquid in a relatively uniform manner regardless whether the device is 100 percent or 10 percent full. This is a significant advantage over prior art devices in which liquid pressure varies dramatically as a function of liquid volume.

To achieve the novel pressure versus volume distribution, it is very important to select an elastic, tubular material for bladder construction which will expand generally spherically from a segment of the bladder until the fully-expanded diameter or cross-section is achieved thereupon the expanded region grows axially. The device shown in the first embodiment of the invention was fabricated using latex surgical tubing having a ¼ inch nominal inside diameter. While other tubing materials may prove to work satisfactorily, the latex surgical tubing which is available from Mid-Michigan Medical Supply in Battle Creek, Mich., works quite well. The shut-off valve used in fabrication of the first embodiment of the invention was similarly purchased from Mid-Michigan Medical Supply and is commercially referred to as an enema tube shut off clamp. All of the components which are used to fabricate the first embodiment of the invention are individually available. The nozzle 24 is formed of a plastic barrel of an inexpensive ballpoint pen. Orifice 42 is the existing opening of the barrel through which the ballpoint pen tip projects. This orifice, approximately 1/16 inch in diameter, results in a very heavy stream of liquid being projected when the valve is partially opened. If a finer stream of liquid or a spray were desired the orifice diameter on construction could be readily changed to achieve such result. It has been found that the plastic cable ties work quite satisfactorily to affix the elastic bladder to the nozzle 24 and plug 36. Plug 36 is merely formed of a ¾ inch rivet blank.

The liquid projecting device previously described fabricated from ¼ inch latex surgical tubing was tested to determine the exact pressure/volume relationship which is shown in FIG. 10. A simple pressure gauge was installed in place of plug 36. The unit was completely filled and then liquid was sprayed into a graduated cylinder and pressure readings taken every 100 ml. Test results were as follows:

| VOL. W/IN BLADDER | PRESSURE PSIG |
|---|---|
| 1050 ml. | 12 psig |
| 950 | 11 |
| 850 | 9 |
| 750 | 9 |
| 650 | 9 |
| 550 | 9 |
| 450 | 9 |
| 350 | 9 |
| 350 | 9 |
| 250 | 9 |
| 150 | 9 |
| 50 | 9 |
| 0 | 0 |

Figure 12:
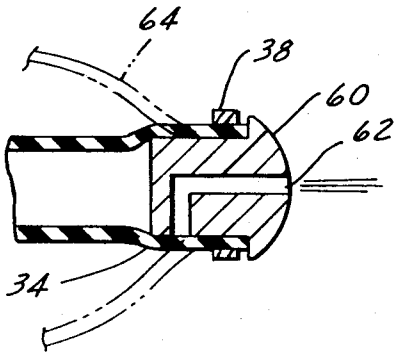
FIG. 12 is a partial cross-sectional view of an alternative plug mechanism employing an overfill pressure relief.

Note the pressure in the elastice bladder was perfectly constant in the 50 to 850 ml. range. As the bladder reached 100 percent capacity, the pressure increased slightly but maintained general uniformity over the entire operating range. When the bladder was intentionally overfilled to determine the volume/pressure relationship after the bladder had reached its fully-expanded diameter throughout its entire length, the pressure increased dramatically and the bladder ruptured before exact measurements could be taken. The area of the curve in FIG. 10 greater than 100 percent volume depicted by dotted lines is therefore estimated that the x representing bladder eruption. The tubing selected results in operating pressure of approximately 9 psi which can be inflated using household tap water which is typically 30 psi. Varying the tubing wall thickness could obviously vary the operating pressure of the device. However, the 9 psi range appears to work quite satisfactorily. In order to minimize the tubing rupture caused by overfilling, a rather simple pressure release valve is shown in FIG. 12. Plug 60 is fixed to the second end of the bladder as previously described. Plug 60 is provided with a port 62 which extends from the atmosphere to a region of the plug periphery which is covered by the bladder second end 34 as shown. The plug diameter is sized so that the bladder must be elastically expanded to telescopically slide thereon, thereby maintaining the bladder sealingly engaged with the plug periphery to close off port 62. The bladder is maintained affixed to the plug with a clamp 38 which is installed in such a manner so that port 62 radially exits the plug between the plug end and the clamp location. When the sealed bladder has been completely filled, port 62 will be closed by the bladder. When the bladder is overfilled, the second end of the bladder will expand sufficiently to expose port 62 as shown phantom outline. With port 62 open, the excess fluid will escape from the bladder through port 62 and be vented to the atmosphere thereby minimizing the likelihood of damage due to overfilling the bladder.

In operation, the user will hold the water projecting device 20 with two hands as shown in FIG. 11. To use his left hand in the drawing while holds both the bladder and the valve 26 with the user's thumb activating lever 40. User's right hand holds and aims the nozzle 24 to direct the path of the liquid projected from orifice 42. It is also possible to hold the valve and nozzle in a single hand and activate lever 40 with the user's little finger.

Figure 13:
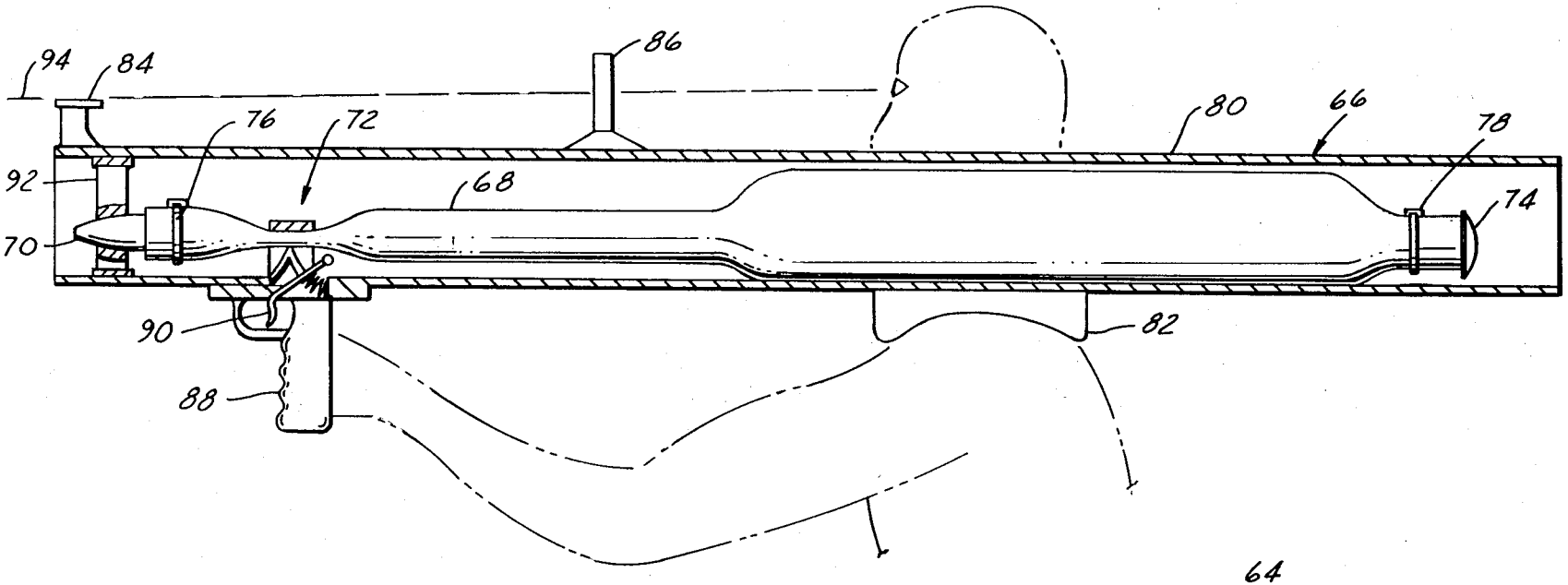
FIG. 13 is a partial cutaway side elevation of an alternative embodiment of the invention held by a user shown in phantom outline.

An alternative embodiment of the invention, intended to be used as a water projecting toy, is shown in FIG. 13. The toy 66 is constructed to simulate a rocket launcher or recoilless rifle. The toy is held by the user shown in phantom outline by resting a portion of the toy on the user's shoulder and holding a handle trigger mechanism located in the forward part of the toy so the toy can be aimed. The toy is provided with a bladder 68, nozzle 70, valve assembly 72, plug 74 and a pair of clamps 76 and 78, all of which operate in a similar manner as the correspondingly-named parts described with reference to the first embodiment of the invention. The entire bladder nozzle assembly is housed within a tubular body 80. The body is provided with a shoulder rest 82, a front and rear site 84 and 86, a pistol grip and a trigger, 88 and 90. Trigger 90 cooperates with the valve assembly 72 to cause liquid to be projected from the nozzle when the trigger is depressed. Nozzle 70 is affixed to body 80 by bracket 92 which orients the nozzle generally parallel to the axis of tubular body 80 and the line of sight 94. The device is filled with water using an adaptor fitted on the end of a garden hose as shown in FIGS. 6 and 7. The device can hold large quantities of water which can be squirted accurately a great distance allowing for a long play time between refills.

The uses of the invention are not limited solely to toy applications. The device is believed to be quite useful in any application where it is desirable to have a portable source of pressurized liquid for spray applications. The application of lawn and garden chemicals and fertilizers is a typical example in which a liquid projecting device of the type described can be utilized. In such application, the plug may be provided with a removable threaded cup to allow insertion of powder chemicals prior to filling with water.

It will also be understood, of course, that while the form of the invention herein shown and described constitutes a preferred embodiment of the invention, it is not intended to illustrate all possible forms thereof. It will also be understood that the words used are words of description rather than limitation and various changes may be made without departing from the spirt and scope of the invention.

We claim:

1. A liquid projecting device comprising:

an elastic tubular bladder for receiving liquid, said bladder extending along an axis and expanding radially from an initial cross-section to an expanded cross-section upon the introduction of liquid therein; as said liquid is introduced, the bladder expands initially at a local segment until a fully expanded cross-section is achieved, thereafter the expanded region grows axially until the entire effective length of the bladder is expanded, said bladder maintaining a generally constant liquid pressure independent of bladder volume;

a nozzle cooperating with said bladder through which the liquid contained therein is projected; and a valve means cooperating with said bladder and said nozzle to control the flow of liquid through said nozzle.

2. The invention of claim 1 wherein said valve means comprises a clamp which pinches a segment of the tubular bladder, said clamp being shiftable between an open position wherein liquid may flow through the tube segment and a closed position wherein the flow is restricted.

3. The invention of claim 1 wherein said nozzle further comprises a tubular body having a first and second end, said first end cooperating with the tubular bladder forming a fluid-tight connection therewith and the second end provided with an orifice for controlling the flow of liquid projected from the device.

4. The invention of claim 3 wherein said bladder is formed of a flexible elastic tube having a first and second end, said first end telescopically engaging the periphery of the nozzle first end.

5. The invention of claim 4 further comprising a first clamp circumaxially surrounding the tube first end to affix the tube to the nozzle.

6. The invention of claim 5 further comprising:

a plug sealingly, telescopically fitted within the tube second end, and a second clamp circumaxially surrounding the tube second end to sealingly affix the tube to the plug.

7. The invention of claim 6 wherein said valve means comprises a clamp which pinches a segment of the tubular bladder, said clamp being shiftable between an open position wherein liquid may flow through the tube segment and a closed position wherein the flow is restricted.

8. The invention of claim 1 wherein the initial expansion of the bladder is from a local point and increases generally spherically therefrom until the expanded bladder segment has reached the fully expanded diameter.

9. The invention of claim 1 wherein the bladder is formed of a flexible elastic tube having a first and second end, said first end telescopically engaging the periphery of the nozzle first end.

10. The invention of claim 9 further comprising a plug coaxially cooperating with the tube second end which is elastically stretched thereover.

11. The invention of claim 10 wherein said plug is provided with a port extending therethrough and having a first and second opening at each end of the port, said second opening formed in a portion of the plug exposed to atmosphere and the first opening formed in a portion of the plug exposed to the tubular bladder in a region which causes the bladder to normally seal the port in an isolated manner from the liquid in the bladder, and which will communicate with said liquid in the bladder upon the overfilling of the bladder thereby causing the bladder to elastically deform sufficiently to expose the first port.

12. A relief valve for use in conjunction with a tubular elastic bladder, containing a pressurized liquid, said valve comprising:

a generally cylindrical plug body having formed therethrough a port having a first and second opening, the first opening formed in a region of the plug cylindrical periphery normally sealed by the tubular bladder and said second opening exposed to atmosphere whereupon overfilling of the bladder causes the bladder to elastically deform sufficiently to expose the first port to said liquid within the bladder.

13. A water-projecting toy to be held by user comprising:

a tubular, cylindrical body;

an elastic tubular bladder for receiving a liquid, said bladder extending along an axis and expanding radially from an initial cross-section to an expanded cross-section upon the introduction of liquid therein; as said liquid is introduced, the bladder expands initially at a local segment until a fully expanded cross-section is achieved, thereafter the expanded region grows axially until the entire effective length of the bladder is expanded, said bladder maintaining a generally constant liquid pressure independent of bladder volume; and said bladder housed within and generally supported by said body.

14. The invention of claim 13 further comprising a handle affixed to said body to enable a user to hold the device.

15. The invention of claim 14 further comprising a trigger to be activated by the user to cause the liquid to be projected from said device, said trigger cooperating with the valve means and mounted adjacent to said handle.

16. The invention of claim 12 further comprising means for clamping said elastic bladder to the periphery of the plug body to prevent the separation thereof.

17. A relief valve for cooperation with the end of a tubular elastic bladder and a pressurized fluid, said valve comprising:

a plug body sized to allow the end of the elastic bladder to be elastically stretched thereof, said plug having formed therein a port having a first and second opening, the first opening formed in a region of the plug periphery so that it is normally sealed by the tubular bladder, whereupon the overfilling of the bladder causes the bladder to deform sufficiently to expose the first port to said fluid within the bladder allowing it to be vented through the ports second opening.

18. The invention of claim 17 further comprising means for clamping said elastic bladder to the periphery of the plug body to prevent the separation thereof.

* * * * *

UNITED STATES PATENT AND TRADEMARK OFFICE

CERTIFICATE OF CORRECTION

PATENT NO. : 4,735,239

DATED : April 5, 1988

INVENTOR(S) : Michael E. Salmon and John Briski

It is certified that error appears in the above-identified patent and that said Letters Patent is hereby corrected as shown below:

In the Claims

In claim 13, column 6, line 41, please delete the punctuation mark "." immediately following the word "body" and insert in its place:

---;

a nozzle cooperating with said bladder and supported by said body through which the liquid contained in the bladder is projected; and a valve means cooperating with said bladder and said nozzle to control the flow of liquid through said nozzle.---

Signed and Sealed this

Thirteenth Day of September, 1988

*Attest:*

*Attesting Officer*

DONALD J. QUIGG

*Commissioner of Patents and Trademarks*